US008903689B2

(12) United States Patent
Dunbabin et al.

(10) Patent No.: US 8,903,689 B2
(45) Date of Patent: Dec. 2, 2014

(54) AUTONOMOUS LOADING

(75) Inventors: Matthew Dunbabin, Queensland (AU); Kane Usher, Queensland (AU)

(73) Assignee: Commonwealth Scientific and Industrial Research Organisation, Campbell, Australian Capital Territory (AU)

( * ) Notice: Subject to any disclaimer, the term of this patent is extended or adjusted under 35 U.S.C. 154(b) by 372 days.

(21) Appl. No.: 13/380,467

(22) PCT Filed: Jun. 23, 2010

(86) PCT No.: PCT/AU2010/000792

§ 371 (c)(1),
(2), (4) Date: Apr. 10, 2012

(87) PCT Pub. No.: WO2010/148449
PCT Pub. Date: Dec. 29, 2010

(65) Prior Publication Data

US 2012/0191431 A1 Jul. 26, 2012

(30) Foreign Application Priority Data

Jun. 25, 2009 (AU) ..... 2009902954

(51) Int. Cl.
*G06G 7/48* (2006.01)
*E02F 9/20* (2006.01)
*E02F 9/26* (2006.01)

(52) U.S. Cl.
CPC ..... *E02F 9/262* (2013.01); *E02F 9/2029* (2013.01); *E02F 9/265* (2013.01)
USPC ..... 703/6

(58) Field of Classification Search
CPC ..... A47J 31/00; B05B 9/06; B60P 1/04; B60W 30/18; B60W 10/06; B60W 10/10; B65B 57/20; B65B 3/04; B65B 61/20; B65G 37/00; B65G 59/00; B65G 65/02; B65G 67/00; B66F 9/00; E02F 3/04; E02F 3/34; E02F 7/00; E02F 1/00; F02F 3/60; G01C 22/00; G05B 21/00; G05B 19/18; G01S 5/02; G05D 1/00; G06F 7/00; G06F 15/20; G06D 1/00; G06G 7/48; G06K 9/00; H04B 7/185
USPC ..... 703/6; 371/414, 348; 342/357.27; 701/50; 414/469
See application file for complete search history.

(56) References Cited

U.S. PATENT DOCUMENTS 5,493,798 A * 2/1996 Rocke et al. ..... 37/348
6,058,344 A * 5/2000 Rowe et al. ..... 701/50

(Continued)

FOREIGN PATENT DOCUMENTS

AU 199895225 A1 7/1999

OTHER PUBLICATIONS

Corke, Peter et al., ACARP Project C12030 Rope Shovel Automation, Technical report, ACARP, Jun. 2004, 61 pages.

(Continued)

*Primary Examiner* — Kandasamy Thangavelu
(74) *Attorney, Agent, or Firm* — Brinks Gilson & Lione

(57) ABSTRACT

This invention concerns autonomous loading, that is autonomously dumping material one load at a time into a receptacle until it is full. In particular the invention involves a control method and system for the dumping equipment that performs one or more operational cycles, each of which involves: Positioning a dumping point of the loading equipment at a predetermined location above a receptacle to be loaded. And, dumping a quantity of material having less than or equal to a known volume into the receptacle from the dumping point. Wherein, the control method comprises the steps of: Simulating the effect of dumping the volume, using the material's repose angle, from various locations above the receptacle. Comparing the result of dumping at each location with a template representing an ideally filled receptacle. And, selecting the location of the dumping point according to the results of the comparison. The invention can be applied to any type of mining machine, including rotating equipment such as rope shovels, and other types of machines such as a draglines, excavators or conveyers.

14 Claims, 13 Drawing Sheets

(56) References Cited

U.S. PATENT DOCUMENTS

| | | | | |
|---|---|---|---|---|
| 6,114,993 | A * | 9/2000 | Henderson et al. | 342/357.27 |
| 6,363,632 | B1 * | 4/2002 | Stentz et al. | 37/414 |
| 2004/0158355 | A1 | 8/2004 | Holmqvist et al. | |
| 2008/0219820 | A1 * | 9/2008 | Kiegerl et al. | 414/469 |

OTHER PUBLICATIONS

Hansen, J., Electric rope shovel monitoring, CIM Bulletin, 94(1052), Jul. 2001, pp. 80-82.

Lever, Paul et al., ACARP Project C11054 Open-cut Automation Scoping Study, Technical report, CMTE, 2003, 89 pages.

Sheppard, Greg et al., Real Time Shovel Operator Feedback System, Final report, ACARP, CMTE, Aug. 2003, 45 pages.

Winstanley, G. et al., Dragline Swing Assist: ACARP C9028—Final Report. Technical report, ACARP, 2003, 31 pages.

H.N. Cannon. Extended earthmoving with an autonomous excavator. Master's thesis, The Robotics Institute, Carnegie Mellon University, Pittsburgh, PA 15213, May 1999.

P. Corke, P. Sikka, J. Roberts, and E. Duff. DDX: A distributed software archetecture for robotic systems. In *Australasian Conference on Robotics & Automation*, Canberra, Dec. 2004.

M. Dunbabin, P. Corke, G. Winstanley, and J. Roberts. Off-world robotic excavation for large-scale habitat construction and resource extraction. In *To Boldly Go Where No Human-Robot Team Has Gone Before: Papers from the 2006 Spring Symposium*, ed. Terry Fong, pp. 95-103. Technical Report SS-06-07. American Association for Artificial Intelligence,Menlo Park, California, 2006.

H. P. Moravec and A. Elfes. High resolution maps from wide angle sonar. In *IEEE International Conference on Robotics and Automation*, pp. 116-121, St. Louis, Missouri, USA, 1985. IEEE Computer Society Press.

J. Roberts, G. Winstanley, and P. Corke. Three-dimensional imaging for a very large excavator. *International Journal ofRobotics Research*, 22(7-8):467-477, 2003.

S. Singh. Learning to predict resistive forces during robotic excavation. In *International Conference on Robotics & Automation*, pp. 2102-2107, Nagoya, May 1995.

S. Singh. The state of the art in autonomous earthmoving. *ASCE Journal of Aerospace Engineering*, 10(4), Oct. 1998.

Stentz, A. et al., "A Robotic Excavator for Autonomous Truck Loading", Proceedings of the IEEE/RSJ International Conference on Intelligent Robots and Systems, Victoria Canada, Oct. 13-17, 1998, pp. 1885-1893.

International Search Report and Written Opinion from priority application PCT/AU2010/000792 dated Aug. 16, 2010.

* cited by examiner (a)

(b)

(a)

(b)

AUTONOMOUS LOADING

This application is a National Stage of International Application No. PCT/AU2010/000792 filed on Jun. 23, 2010, which claims priority to Australian Patent Application No. 2009902954, filed on Jun. 25, 2009, the entirety of which is hereby incorporated by reference.

TECHNICAL FIELD

This invention concerns autonomous loading, that is autonomously dumping material one load at a time into a receptacle until it is full. In particular the invention involves a control method and system for the dumping equipment. The invention can be applied to any type of mining machine, including rotating equipment such as rope shovels, and other types of machines such as a draglines, excavators or conveyers.

BACKGROUND ART

In general robotic excavation investigations have focused around digging, weight estimation and motion planning. Singh [11] provides a good review of the field and discusses state-of-the-art in sensing and machine/ground interaction models. He then uses a number of implemented systems as examples to illustrate different levels of autonomy: teleoperation, trajectory control, tactical and strategic planning.

A significant body of relevant work was conducted at Carnegie-Mellon University by Singh, Cannon, Rowe, Stentz and others in the 1990s. Cannon [1] conducted a comprehensive study and experimental evaluation of an autonomous 25 tonne hydraulic backhoe type excavator.

Australian Patent Application No 199895225 (Carnegie Mellon University) [13] describes a template-based loading strategy using perceptual feedback. In this patent a digital map of the height and shape of the load in a partially loaded truck is processed, together with templates that represent the ideal distribution of the load. In particular the map and template are similarly gridded and a correlation is calculated between the map and template for at least some of the cells of the grid. The optimal location for the next dump into the truck is selected using the results of the correlation calculations.

In earlier work related to automating dragline dig-dump-dig motion. One system was evaluated in a production trial which moved 250,000 tonnes of material in a two week period [12]. In addition to the dragline control system, other technologies have been developed, including digital terrain mapping and a safe and intuitive human-machine control interface. In 2005, this work was extended to include autonomous digging with complete autonomous dragline excavation and dumping operations demonstrated [4].

DISCLOSURE OF THE INVENTION

The invention is a control method for loading equipment that performs one or more operational cycles, each of which involves:

Positioning a dumping point of the loading equipment at a predetermined location above a receptacle to be loaded.

And, dumping a quantity of material having less than or equal to a known volume into the receptacle from the dumping point.

Wherein, the control method comprises the steps of:

Simulating the effect of dumping the volume, using the material's repose angle, from various locations above the receptacle.

Comparing the result of dumping at each location with a template representing an ideally filled receptacle.

And, selecting the location of the dumping point according to the results of the comparison.

This loading strategy relies on the use of a 'simulated load', and comparing this simulated load to a template of an ideal load for the particular loading receptacle in question. Other factors may be taken into account by the simulation, including particle size, distribution, voiding and spillage. The simulated load may be iteratively tested over the valid loading workspace to find the 'best' loading position.

A cost is generally assigned to each simulated loading point so that the best loading point can be selected based on this cost.

The invention may benefit from imaging the receptacle and load as it is filled. This enables feedback to inform the simulation process. Imaging may be performed using a scanning laser range-finder, or any other suitable means. The imaging may be performed either off or on the loading equipment. When mounted on rotary loading equipment the range finder may scan in a vertical plane in such a way that rotational motion of the loading equipment can be used to build up a three-dimensional point cloud of the surrounding terrain; from which a Digital Terrain Map (DTM) can be generated. In this way as the loading equipment moves to the dumping point, the receptacle can be segmented from the background image and the 'ideal' loading point selected before the dumping point is reached. In addition the new surface of the load in the receptacle can be scanned as the loading equipment moves away.

Imaging of the receptacle may take account of shadowing effects of the scanning, that is to compensate where there are hidden parts of the interior of the receptacle.

If the receptacle was to be loaded from both sides, two imaging systems would be required, one for each side.

The method may be extended to identify the receptacle, its location, orientation and geometry in 2 or 3 Dimensions. The position of the receptacle may be reported to the loading equipment using, for example GPS, to seed and restrict a search. At the start of loading the fillable part of the receptacle needs to be identified, and this can be determined using a priori knowledge of the loading receptacle. For example, using template-based strategies.

The load may be simulated using knowledge of the fillable part of the empty or partially filled receptacle, including The shape of the surface of the receptacle and the upper surface of any load in it.

The maximum volume of the dump, that is the greatest volume that the excavation machinery is able to dump, for instance the volume of the bucket of a rope shovel.

And the repose angle of the material.

From this information a shape at least equal to, and usually larger than, the volume of a full dump can be generated, for instance a cone with sides sloping at the repose angle of the material. Then, this shape is incrementally inserted (or retracted), layer by layer with the desired degree of precision, down into the top surface of the empty or partially filled receptacle, until the volume of the shape extending above that surface is equal to volume of the dump.

For instance, when the receptacle is empty with a flat bottom the shape, a cone with sides at the angle of repose, a flat bottom and the same volume as the dump, is simply lowered onto the bottom of the receptacle. In this location the volume of the cone extending above the flat bottom is equal to the maximum volume to be dumped.

However, when the receptacle is partially filled the upper surface of the existing load in it will generally not be flat. In this case the shape is inserted into the upper surface until the volume of the shape extending above the surface, having a bottom surface the same shape as the upper surface of the existing load, is equal to the maximum volume to be dumped.

The control system will generally determine whether the receptacle is full or not during each cycle of the simulation. The receptacle is considered full when it is not longer possible to find a location at which an entire dump can be accommodated within (an upper surface of) the receptacle template.

The invention is suitable for automated or operator-assist type systems and can deal with single and multi-pass fills. Additionally, it can be used to estimate the volumes loaded into the tray, total volume moved and the 'carry-back'. (Carry-back is the portion of load in a truck tray which 'sticks' in the tray and is carried back and forth unnecessarily).

In another aspect the invention is a control system for loading equipment that performs one or more operational cycles, each of which involves:

Positioning a dumping point, of the loading equipment, at a predetermined location above a receptacle to be loaded.

And, dumping a quantity of material having less than or equal to a known volume into the receptacle from the dumping point.

Wherein, the control system comprises a computer system programmed to:

Simulate the effect of dumping the volume, using the material's repose angle, at various locations above the receptacle.

Compare the result of dumping at each location with a template representing an ideally filled receptacle.

And, select the location of the dumping point according to the results of the comparison.

In a further aspect the invention is software for programming a computer to perform the method.

BRIEF DESCRIPTION OF THE DRAWINGS

An example of the invention will now be described with reference to the accompanying drawings, in which.

BEST MODES OF THE INVENTION

Figure 1:
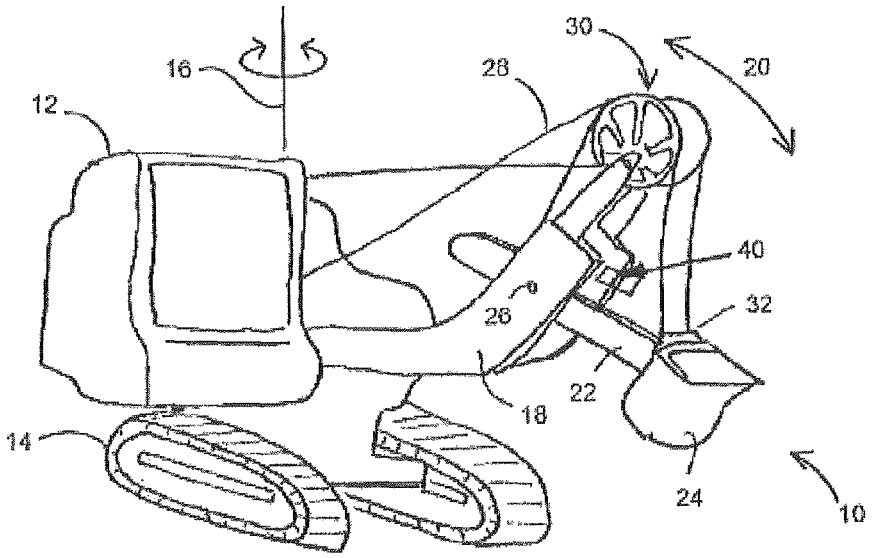
FIG. 1: is a pictorial diagram of a scale model electric rope shovel.

The invention has been investigated using a 1/7th scale model electric rope shovel 10 as shown in FIG. 1. This model has a cab 12 mounted on caterpillar tracks 14. The cab can turn about the swivel axis 16. A kinked boom 18 extends forward of cab 12 and can be raised and lowered, see arrow 20, about a hoist axis (not shown). And a crowd arm 22 holds a dipper 24 forward from boom 18 and pivots about pivot point 26.

In its operation shovel 10 is identical to a full-scale shovel with electrically driven ropes 28 extending over the hoist sheaves 30 to the bail arm 32 for actuating the dipper mechanism. Although the scale model 10 looks unconventional when compared to a production machine due to the "kink" in the boom, all the critical dimensions of the shovel: pivot height, hoist sheave position, crowd arm length and dipper size are accurately scaled from production shovels. The model shovel's bucket 24 volume is approximately 0.16 $m^3$.

The shovel 10 has three electric motors which provide drives for crowd, hoist and swing. Rope shovel digging and loading operations require control of all three drives: crowd, hoist and swing. The mathematical transformation between the crowd and hoist rope lengths and swing angle (c, h and ' respectively), and the Cartesian coordinates of the dipper teeth is a problem in kinematics. The transformation is non-linear and depends strongly on various parameters of the rope shovel, including minimum crowd extension and hoist rope length, position of the hoist sheave, position of the dipper teeth with respect to the crowd arm, offset of the crowd arm centre line from the crowd pivot point, and the position of hoist bail arm with respect to the crowd arm.

Equations for the forward and inverse kinematics were derived and made accessible for the control software via a modular system. A modular system approach was adopted to allow the system to be transferred to any shovel with only the kinematic module requiring updating between machines.

The shovel 10 is operable under the control of a computer via a single network connection. A laser scanning system 40 is mounted near the top of the boom 18 to collect data for a control and planning system.

Control and Planning System

Figure 2:
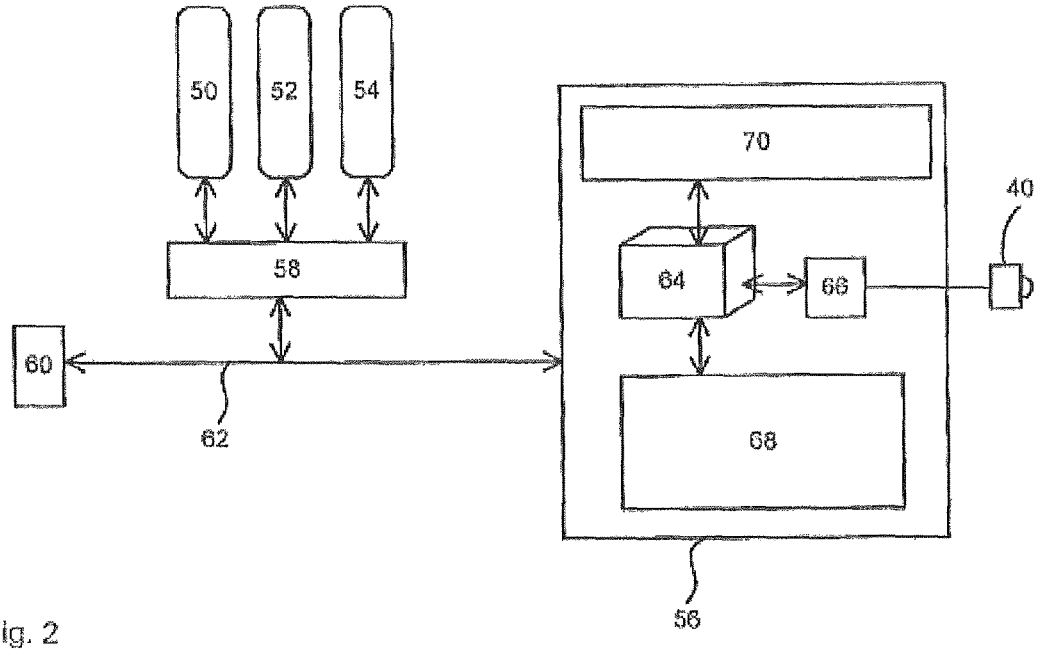
FIG. 2: is a diagram of control system architecture and hardware layout for the shovel of FIG. 1.

The computer control structure is shown in simplified schematic form in FIG. 2. The three electric motor drive controllers 50, 52 and 54 and their encoders are connected to computer 56 via an interface 58, data acquisition modules 60 and an onboard local area network 62.

Three programs are involved, connected by a "blackboard" architecture 64 [3] through which they share information:

A controller 66 ensures crowd and hoist extensions and swing angle achieve the desired values, and updates the drive states (extension, current, voltage) on the blackboard at 10 Hz.

A laser interface 68 reads data from the laser scanning system 40 and places it on the blackboard.

A motion (task) planner 70 uses information from the blackboard 64 to plan the path that the bucket teeth should follow at a rate of 5 Hz.

The tracking performance of each of the shovel's controlled axes (crowd, hoist and swing) is optimised by on-line tuning of each control gain to achieve the desired tracking response to rapid step position set-point changes [2].

To demonstrate autonomous truck loading using the 1/7 scale model shovel 10, a suitably scaled model truck tray was required. For easier transportation and dumping of material, a tray was installed within a commercially available box trailer at the appropriate height.

The laser scanning system 40 comprises two range scanning sensors to scan the shovel's surrounds, including the dig face, as the machine swings. The laser scanners have a maximum range of 50 m and scan over 100 degrees at 0.25 degree intervals. A first scanner monitors the dig face along the dipper arm. A second scanner is offset from the first for unobstructed scanning of the environment to generate high quality Digital Terrain Maps (DTMs) of the area [8].

Calibration

The shovel 10 can be set-up as either a rope-shovel or as a dragline, with a simple change of the boom and rigging. The machine's geometry changes significantly as it is converted between a shovel and dragline. As a result it was necessary to calibrate all the key geometric parameters for accurate digging and loading operations. Therefore, auto-calibration routines are provided which have the ability to determine:

1. Shovel geometry with respect to the laser, and
2. Laser geometry with respect to the ground.

Both routines use the on-board laser scanners 40 as part of their self-calibration routines, and are designed to estimate the geometric parameters whilst in the field. The algorithms are applicable to both electric and hydraulic shovels. An advantage of such systems are the ability to easily calibrate systems retrofitted to existing shovels.

In order to know where the dirt is with respect to the shovel it is necessary to know where the laser is with respect to the shovel, and the geometric parameters of the shovel for the kinematic models. A self-calibration process was established that uses the laser to estimate the dipper handle angle and the position of the hoist rope pivot, and compares this with what would be expected from measured extensions and the kinematic model. Next all the points are rotated so that the dipper handle is horizontal and passes through the origin, and then heuristics estimate the top of the bail arm 32.

A numerical optimisation procedure is then used to minimize the error between the laser observation and the prediction based on measured crowd extension and hoist rope length by adjusting the kinematic parameters. Using this approach we are able to estimate the position of the laser as well as hoist and crowd offset and sheave position.

Figure 3:
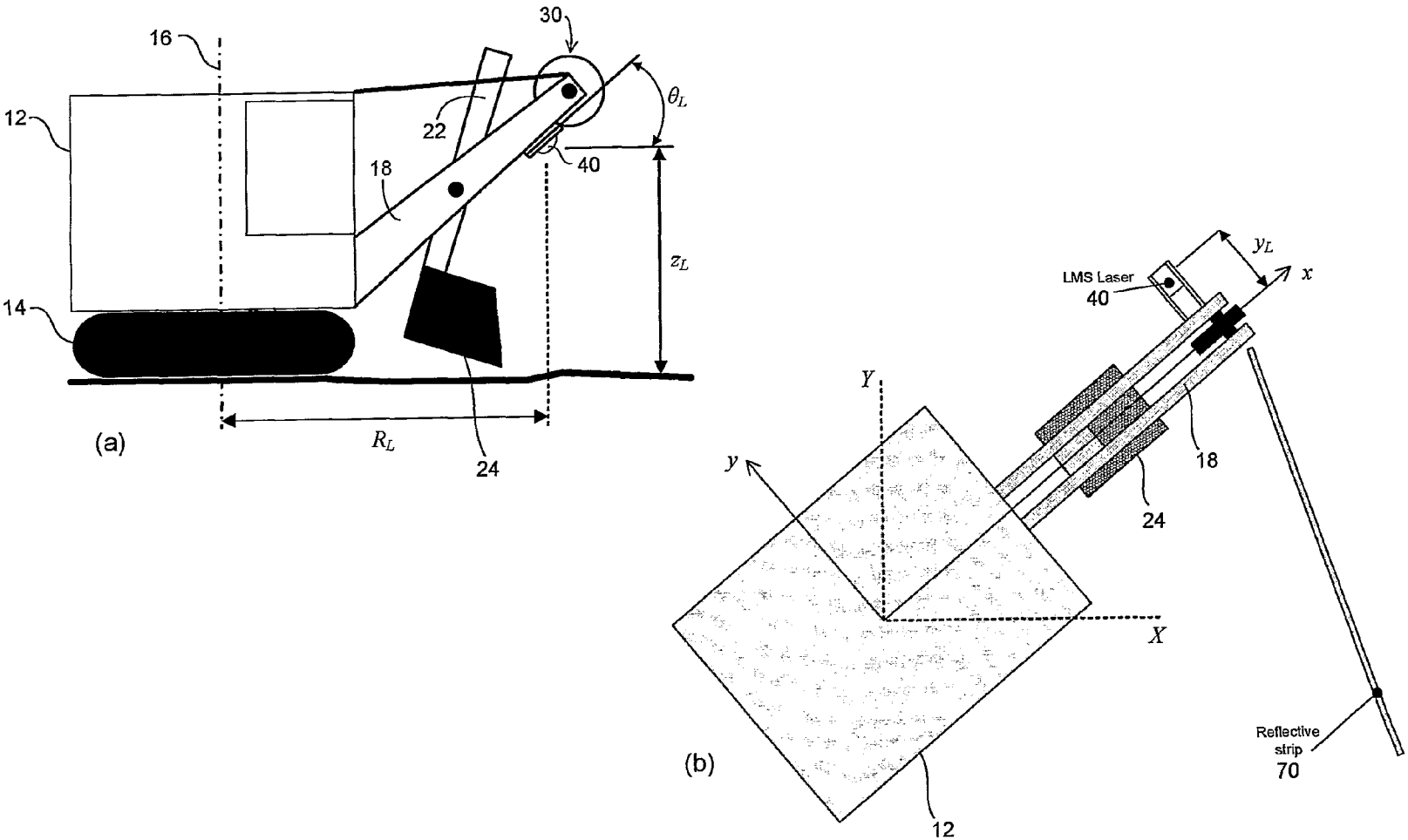
FIG. 3(*a*) is an elevation, and FIG. 3(*b*) is a plan view, of the shovel of FIG. 1.

In order to calibrate the laser scanners with respect to the ground a numerical optimisation strategy was developed. The key parameters that need to be estimated for each laser are the radius from an origin ($R_L$), the orientation of the laser with respect to the ground ($\|_L$), the laser horizontal offset ($y_L$) and the height above the origin ($z_L$) as shown in FIGS. 3(*a*) and (*b*). The basis of the strategy relies on the fact that the shovel 10 rotates about a central pivot 16. Therefore, the origin is taken as the vertical pivot 16 location at flat ground level.

The calibration strategy consists of two stages and requires the machine to be on reasonably flat/level ground, and to scan a straight reflective stripe. As the laser scanners return intensity values, reflective tape is easily detected as the machine swings.

The first stage relies on the assumption of the ground being level. Therefore, a single scan from the laser determines the range to the ground at set intervals. By fitting a line to the entire scan, its gradient ($m_s$) can be determined. The orientation of the laser is then determined as $\|L=\tan-1\ (m_s)$. The height of the laser ($z_L$) is then taken as the mean height of the scan after compensating the scan calculation with the approximated laser orientation.

To improve the accuracy of the measurement, an average of the laser orientation and height above the ground is taken as the machine swings. This helps eliminate any local effects of ground profile that may be present at the test site.

The second stage is based on the identification of a straight reflective stripe. The idea here is that, as the machine swings, it should 'see' a straight line as a straight line. If for some reason the laser radius ($R_L$) or its offset ($y_L$) are not accurate, the straight line will appear curved. Therefore, to calibrate these parameters, the machine swings over a reflective stripe as shown in FIG. 3(*b*) and the position of the reflective stripe with respect to the laser scanner is recorded. The position of each of the reflective stripe scans is transformed to a consistent global 2D coordinate system using the machine's measured swing angle (').

A cost function for the optimisation is based on fitting a least squares line to the scanned data and calculating the error between the observed points and the line such that the error function $e \simeq y_i-((m_{fit} \cdot x_i+c_{fit})$ is minimised.

A comparison of the auto-calibration routine solution against measurement gives results that are very similar, with better precision achievable from the numerical optimisation procedures.

Terrain Mapping

Figure 4:
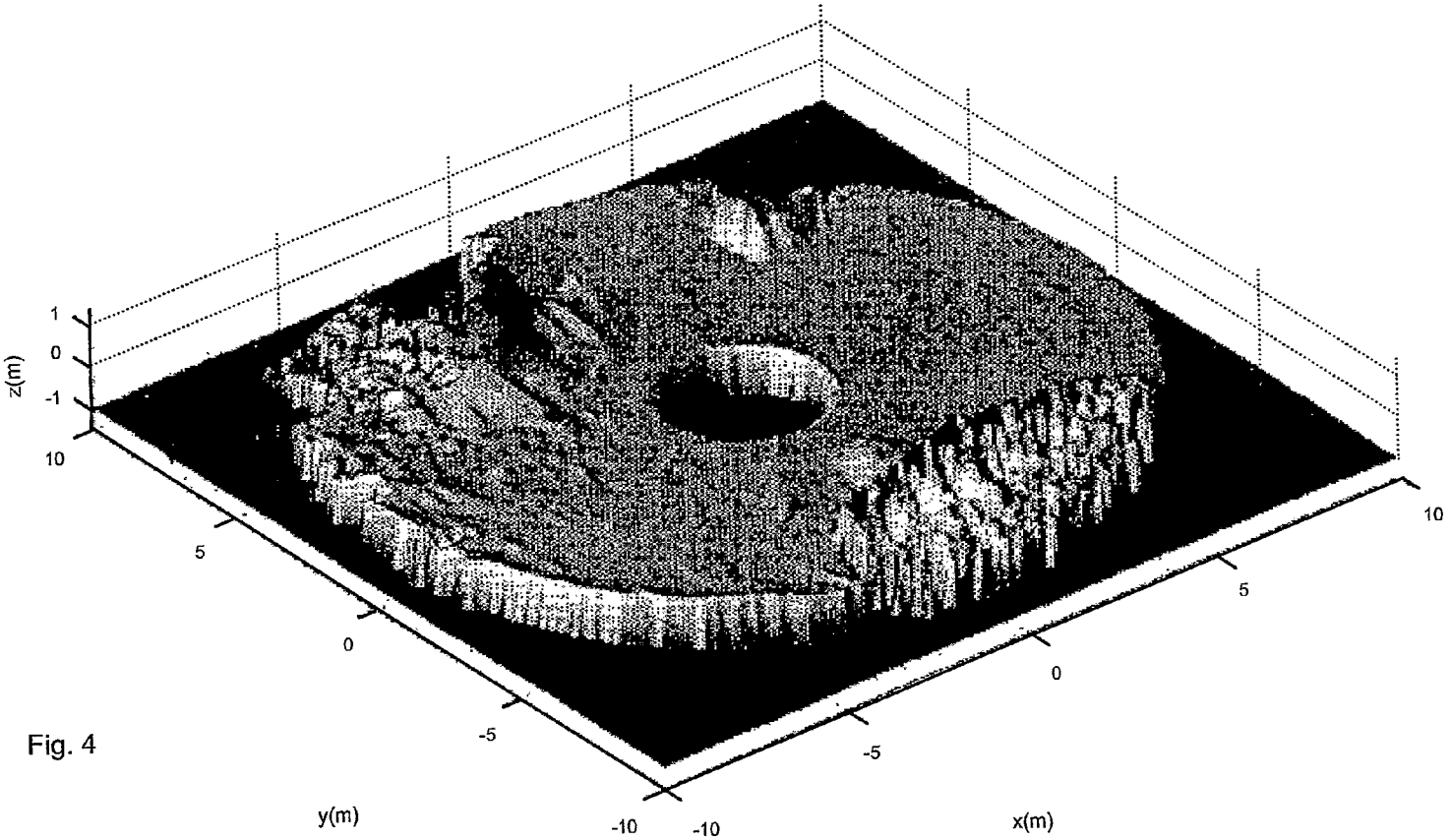
FIG. 4 is a 3D Digital Terrain Map (DTM) of the shovel's surrounds.

A benefit of incorporating the laser scanning system 40 is that as the shovel rotates it is capable of scanning the terrain. As a result high-quality digital terrain maps of the environment surrounding the shovel can be generated by rotating the shovel 10 about its swing axis 16 allowing the scanning line to profile the terrain. FIG. 4 shows a typical terrain map containing all the scanned points generated by rotating the shovel single pass through 360 degrees. These digital terrain maps contain sufficient detail to be utilised in planning optimal dig locations and obstacle avoidance, as well as excavated volume estimation.

In addition to complete 360 degree terrain maps, parts of the terrain profile can be updated in real time as the machine performs excavation and loading cycles. For instance the changing dig face and a truck/tray can be seen as it arrives and waits.

Autonomous Truck/Tray Identification

This section describes two methods for robust identification of truck trays. Both methods have been derived such that they require little to no a priori knowledge of the tray type or its location and orientation. The first method is termed a '2D' solution and makes some assumptions to project the scanned tray to a simplified two dimensional representation. The second method is termed a '3D' solution and represents the tray in three dimensions. The first method is faster than the second at the expense of accuracy.

2-D Solution

The 'two-dimensional' tray identification method was developed to detect an awaiting truck in real-time. It was desired to have as little or no a priori information about the tray, and to have a simplified representation of the tray for volume estimation. A tray scanning laser is used to identify the tray using an edge detection method based on gradient discontinuities in the scan. The techniques is outlined in the following sections.

As the shovel swings, the tray scanning laser passes over the tray 110. In this method, the tray is represented in a set of descritized vectors containing the mean height ($z_{mean}$) and mean radius to tray ($r_{mean}$) as a function of swing angle (''). The processed data from the routine is stored within a 'c' structure.

To simplify the processing and representation of the truck tray, the detected tray parameters are stored as it is scanned whilst the machine is swinging. During swinging, the scan line 112 is rarely parallel to the tray edge as shown in FIG.

5(*a*). This complicates the processing, however, to speed up the analysis, the '2D' method does not perform any transformation or correction of the scan and it is stored as it is seen. This assumption introduces a source of error for accurate volume and tray length calculations, however, they are observed to be small and negligible in practice.

Figure 5:
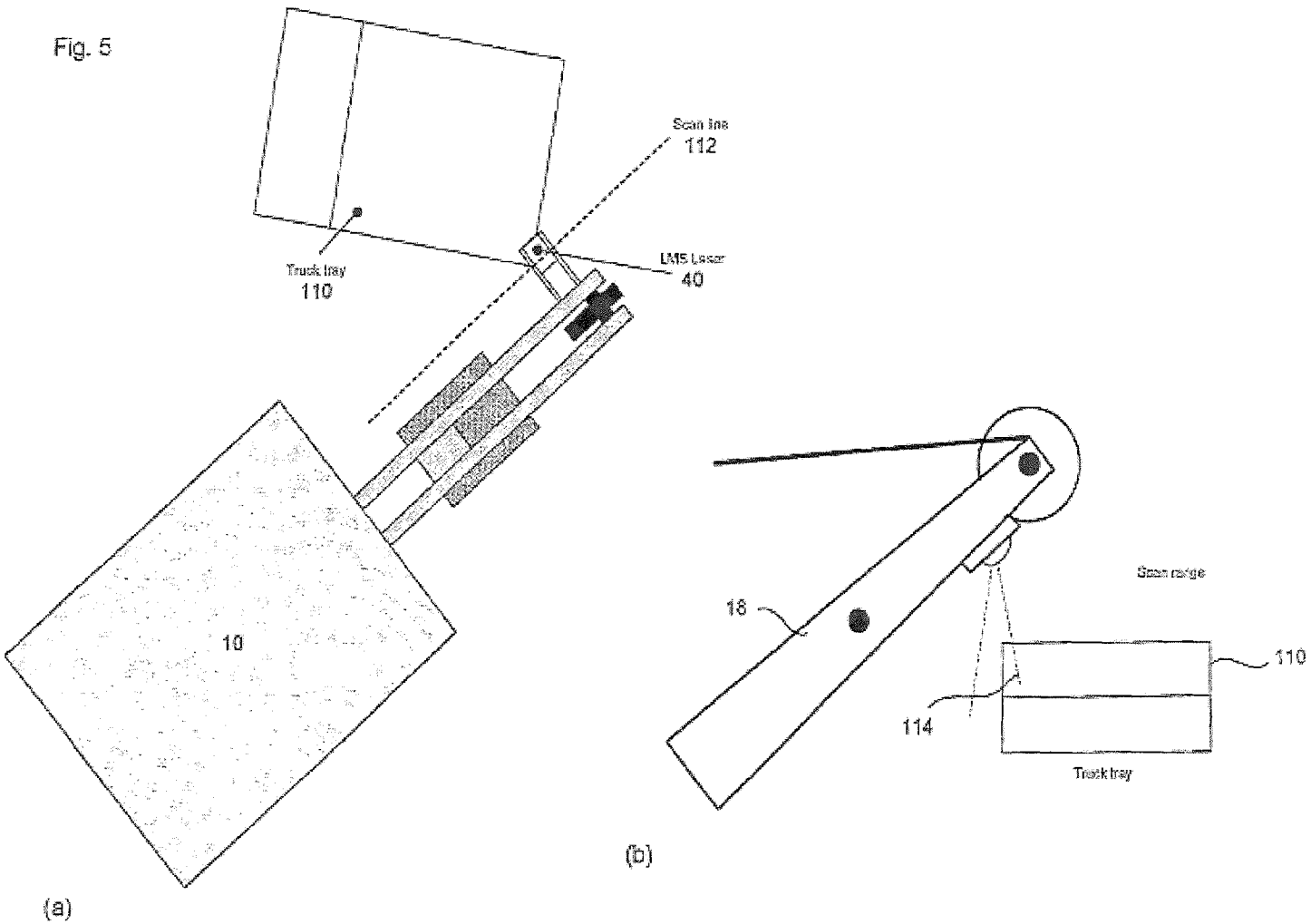
FIG. 5(*a*) is a plan view and FIG. 5(*b*) is an elevation, illustrating a tray scan line.

Other challenges include the effect of 'shadowing' of parts of the truck due to the location of the laser scanner as shown in FIG. 5(*b*). Here it can be seen that at the leading edge of the tray there is a small shadow 114 into the tray and at the trailing edge there will be another shadow. The latter shadow does not effect any volume calculations, however, the first shadow effects internal volume estimation and load distribution. In this solution, this effect is considered small and ignored.

The 2D tray identification procedure is contained within the 'c' function shovel_find_truck_tray( ). It assumes a local coordinate system whose origin is at the center of machine rotation with x projected from the origin out along the dipper arm and z up from the ground. A global coordinate system is also employed which again has its origin at the centre of rotation and X pointing east, Y pointing north and Z up from the ground. Tray identification is performed by processing the laser scan starting from the shovel working outwards. We look for a sharp rise in scan gradient above a certain level (minHeight) within a certain range distance from the shovel (dmin).

Figure 6:
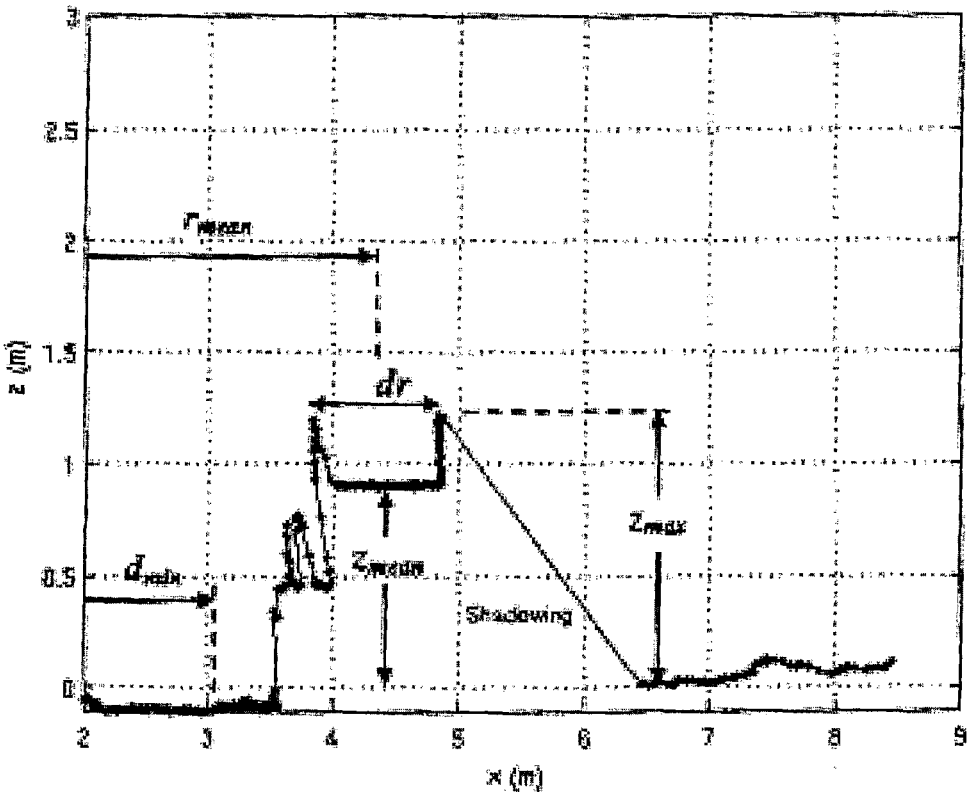
FIG. 6 is plot from a tray scanning laser illustrating key parameters.

FIG. 6 shows a typical scan across the truck tray at swing angle '. When a gradient and height condition is meet, the edgeFound flag is set. On the first instance a valid edge is found, the flag startTray in the TRAYDATA structure is set. The scan processing is continued until either a reverse sharp gradient and height condition is observed, or until the scan range is greater than a conservative preset estimate of a trayWidth. Having a conservative estimate of trayWidth proved effective as the shadowing at the trailing edge was advantageous.

The key parameters are shown in FIG. 6 for representing a tray. These parameters are calculated for each scan across the tray once it has been identified as the shovel swings. The mean radius of the scanned tray centre ($r_{mean}$) is determined from recording the inner and outer distances of the tray edges from the shovel's centre of rotation, $r_{min}$ and $r_{max}$ respectively, and taking the mean of these measurements. The scanned tray width (dr) is defined as $dr=r_{max}-r_{min}$ and gives a reliable estimation when we are away from the tray edges. The maximum edge height ($z_{max}$) is recorded as the mean of the inner and outer edge scan heights, with the mean tray height ($z_{mean}$) being the arithmetic mean of all observed scan heights between the inner and outer edges. In this method, we do not consider the maximum material height in the tray, just the mean.

Figure 7:
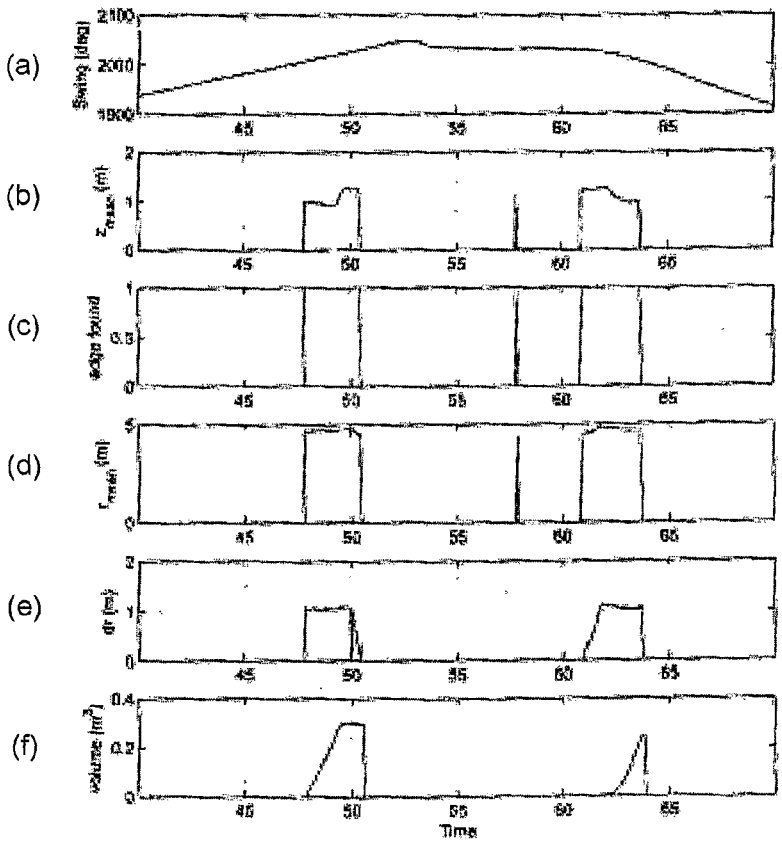
FIGS. 7(*a*) to (*f*) are a series of graphs illustrating a 2-dimensional tray identification method.

This procedure is repeated as the shovel swings and when the scanning laser goes past the front of the tray, the trayFound flag is set. The condition for a trayFound flag to be set is that with the startTray flag set, when a present number of scans (typically two) fail to detect a valid edge and return no edgeFound flags, it is assumed the front or rear of the tray has been swung past and the entire tray has been identified. FIG. 7 shows a time history of the shovel swinging over a tray with the key identification parameters. The first trace (a) shows the swing angle, the second (b) is the mean height of the tray in the scan, the third (c) is the edgeFound flag, the forth (d) is the mean radius of the scanned tray, the fifth (e) is the scanned tray width, and the last (f) is the estimated internal volume.

In this method, the processed scan data is stored in the vectors described in the TRAYDATA structure to be used by the 2D loading optimisation procedure described later.

The performance of the 2D tray identification routine was evaluated under a number of different loading conditions. As a result the tray was found to be accurately segmented with consistent results obtained by scanning in both swing directions. Also, the simplification of non-transforming the scans was found to have a small effect of rounding corners of 2D tray due to the oblique scans across the tray. However, the assumption only causes minimal error and was observed in practice to provide acceptable results for reliable tray position estimation.

There are, however, some limitations to this method, which include the ability to distinguish the exact orientation of the truck, and to compensate for shadowing inside the tray for volume calculations. Additionally, the representation of the loading as a mean height limits the ability to accurately determine bucket placement in the optimised loading strategy as it does not take into account the lateral load distribution.

3-D Solutions

The '3-dimensional' methods for finding the truck tray extend the 2-dimensional method and allow the determination of the position and orientation of the tray, as well as segmentation of the 'fillable' area of the tray. These methods rely on the idea of height encoded occupancy grids and image processing techniques. Two techniques are described here: the first thresholds the truck from the background and then uses image moment calculations to estimate the position and orientation of the truck and tray; the second method refines these estimates with a least median squares optimisation. Each method is described in more detail in the following sections.

As described earlier, the swinging action of the shovel, together with the scanning laser range finder, enables the construction of a point cloud representation of the environment. One way of reducing the complexity of this representation is through the use of 'occupancy grids'. Occupancy grids represent the spatial structure of an environment with an array of cells, each of which is assigned a probability as to whether the cell is occupied. These grids are used for autonomous navigation of mobile robots and were first described by Moravec [7] for this purpose.

Here we are interested in the height of the terrain at each cell and instead of encoding a probability of occupancy in each cell's value, we encode the terrain height. This enables a substantial reduction in the complexity of representation of the terrain data. We encode the height of the terrain as an 'unsigned char' and provide a scaling factor which enables the calculation of the cells true 'height'. Again a 'c' structure is used to represent an occupancy grid. The structure provides two buffers both of which can contain either occupancy grid cell values or other relevant data for processing. The structure also contains scaling factors for each of the buffers, values for the width and height of the grid, offsets in each coordinate direction, and finally the size of each grid cell (assumed to be square). This representation allows for the use of available image processing methods on the occupancy grid data.

Figure 8:
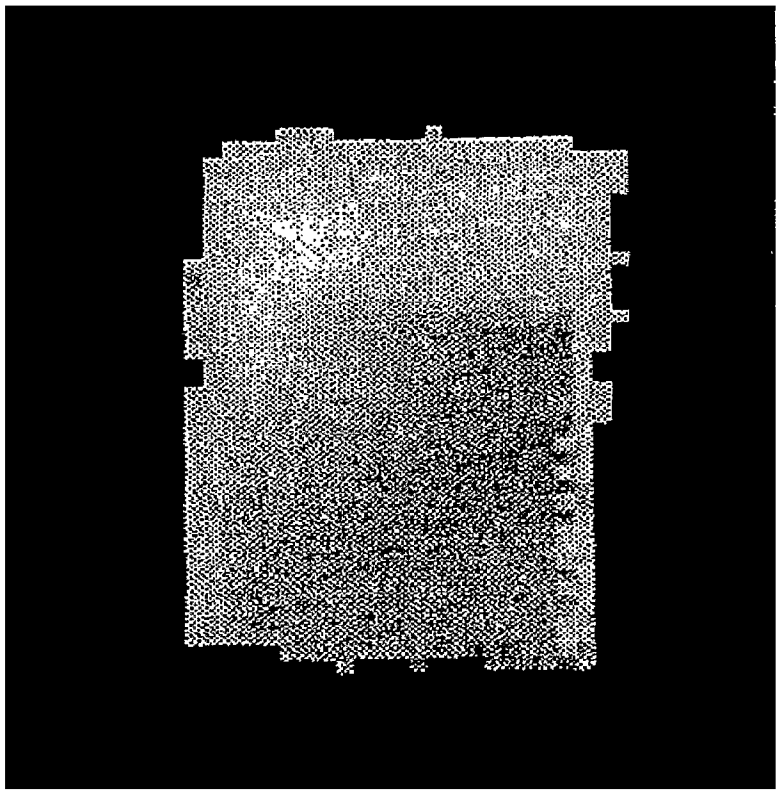
FIG. 8(*a*) is a plan plot, and FIG. 8(*b*) is a 3-dimensional plot of a height encoded occupancy grid.
Figure 8:
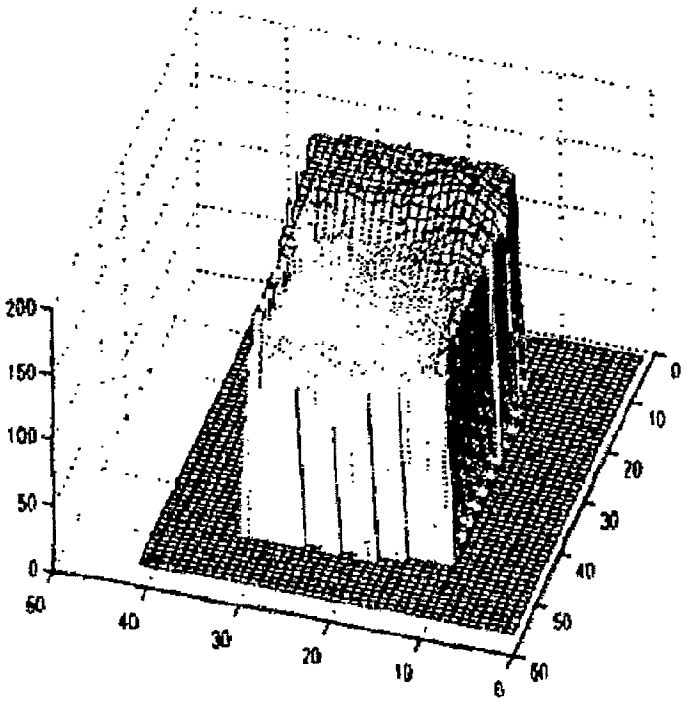

FIG. 8(*a*) shows an example of a height encoded occupancy grid where the grey scale intensity represents the height of items in the environment. Also shown, FIG. 8(*b*), is a 3-D plot of the data. The occupancy grid can be treated as an image but it must be remembered that in its use here it is a Cartesian representation of the environment's structure. In image coordinates the origin is the top left-hand corner of the image, with the x axis (here called the u axis in image coordinates) positive to the right and the y axis (here called the v axis in image coordinates) positive downwards. In real world coordinates, the occupancy grid follows the right-hand rule with the x axis positive up and the y axis positive to the left. In some cases, it is easier to deal with the Cartesian coordinates of a point, in others, the image coordinates are more convenient—in the software implementation of the algorithms described here, a set of macros was created to ease handling of these coordinate transforms.

Finding the Truck and Tray

The truck body and tray can be segmented using the 2-dimensional solution which essentially thresholds the calculated point heights in the environment in order to isolate the truck tray. A difference here is that a height-encoded occupancy grid is constructed from the sensor data. An example of the results of this segmentation is given in FIG. 9(*a*).

Figure 9:
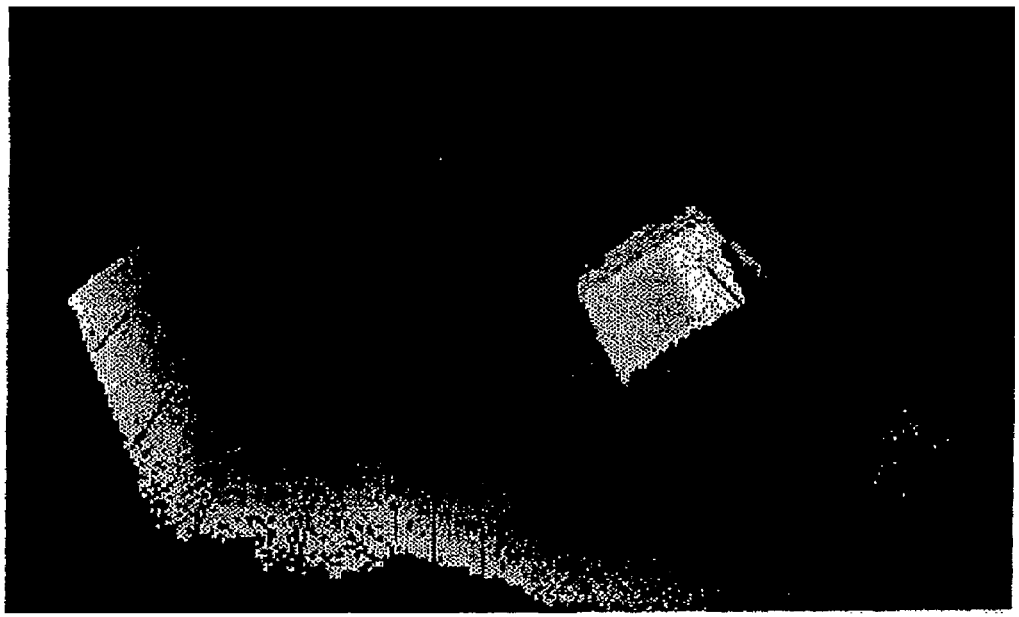
FIG. 9(*a*) is a full occupancy grid of a truck/tray derived by segmentation, and FIG. 9(*b*) is the segmented truck/tray together with an overlayed coordinate frame.
Figure 9:
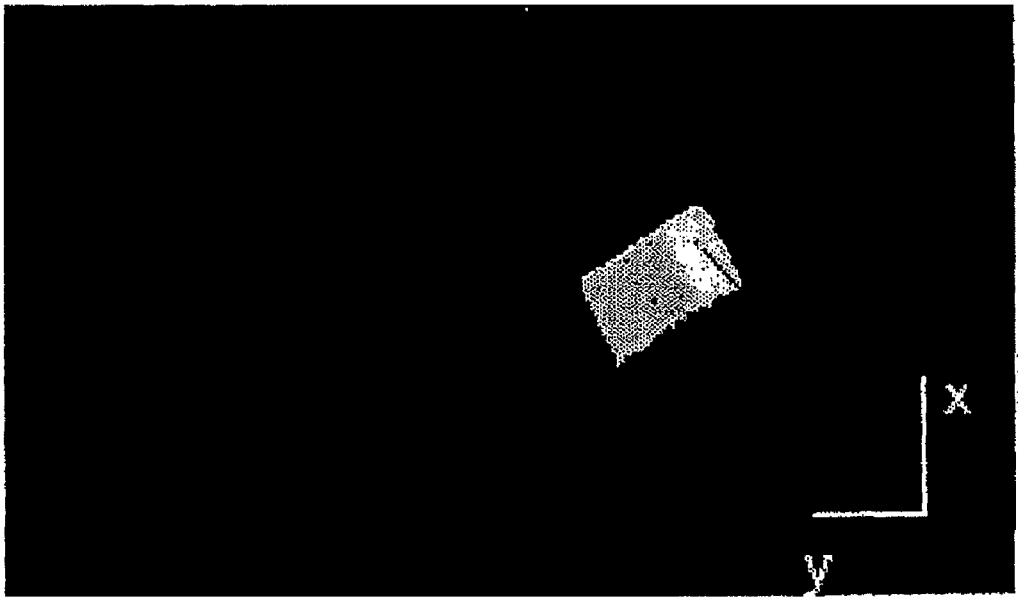

Given this segmented portion of the image, the truck can be localised, as shown in FIG. 9(*b*), and the 'finable' area of the tray can be further segmented using fairly standard image processing techniques. The major steps of the process include:

Step 1: Fill Holes in Image

'Holes' in the image can be problematic for several reasons including distortion of volume estimates and in causing problems with localizing the truck/tray. These holes can appear when the 'radial' resolution of the combination of laser and swing encoder values is low. This can occur when the shovel is swinging at a high rate and also at positions distant from the shovel swing axis. The phenomenon is also dependent on the resolution of the occupancy grid.

Another factor in causing 'holes' in the image is visibility constraints—the sensor geometry can sometimes limit the view 'into' the truck tray. To counteract this effect, a filter was developed to clean-up any holes in the occupancy grid 'image'. This filter operates over all of the pixels in the image using a 3×3 image kernel to fill holes in the image. Basically, if a pixel has no value, and if there are a minimum number of neighbouring pixels with valid values, their average value is applied to the pixel. Of course, the selection of the minimum number of valid neighbouring pixels is important.

If this number is too low, then the object can be effectively grown, similar to the morphological process of image dilation. For the case cited here, the minimum number of valid neighbouring pixels was selected to be 4.

Step 2: Find the Truck/Tray Blob Candidates

Finding the truck/tray in the image is the key step in the procedure. Although, potential truck/tray candidates have been identified using the 2-dimensional procedure, this method can generate false positives, particularly if the structure of the environment is pathological, for example if it contains ridges and valleys at a similar height to that expected of the truck/tray. These false positives must be rejected.

The procedure developed here involves an image labelling operation. Essentially, all pixels which have been identified as possibly belonging to the truck/tray through the initial creation of the occupancy grid are thresholded. These blobs are then labelled using standard image-processing, region-growing type algorithms, discarding blobs which are too small to be the truck tray. Given a set of labelled blobs, these are then analysed for their resemblance to a truck tray using image moment calculations, discarding blobs that are too big or distorted to be a truck tray. The image moment calculations also provide the blob centroid coordinates and the orientation of the longest axis. Using these values, the most likely truck/tray blob candidate is transformed to the origin for further analysis.

Step 3: Find the Truck/Tray Corners

To find the coordinates of the truck tray corners, it is assumed that the truck/tray general shape is rectangular. Given the truck/tray candidate identified above, an edge-finding filter (sobel) is passed over the truck/tray image, which is then thresholded to obtain the strongest edges. A histogram in the u and v directions is then created from this 'edge image'. The first two maximums in each of the histograms indicate the most likely coordinates of the truck/tray corners. Using these coordinates, we can then turn 'off' any pixels which lie outside these coordinates, minimising the effects of noise. The boundary coordinates are then used to crop the image.

Step 4: Determine if the Orientation is Correct

The image moment calculation is performed on a thresholded image and therefore the truck orientation could be 180° out of phase. We use the known structure of the truck tray to correct this. We know, at least for an empty tray, that the headboard over the operator's cabin 'should be' the highest and flattest region in the image. Because of the earlier transformation, the truck/tray axes are now aligned with the image axes, with the longest axis in the 'v' direction. We then perform a sum of the number of pixels in the top half of the image which exceed a height threshold and a corresponding sum for the bottom half of the image. If the sum of the top half of the image is greater than the bottom half, then the orientation of the tuck/tray is correct, otherwise, it needs to be rotated a further 180°, and the appropriate changes made to the truck/tray pose estimates.

Step 5: Segment the Fillable Portion of the Truck/Tray

Identifying the 'fillable' region of the tray is required to constrain the search for optimal loading positions. Finding the coordinates of the fillable area in the tray involves a thresholding of the truck/tray image such that the fillable area of the tray is highlighted. The threshold is set using knowledge of the height of the cover over the operator's cabin and the surrounding structure of the tray. The coordinates of the corners of the fillable part of the tray can then be found using the same process described in Step 3. Other methods could be used here based on other aspects of the geometry of the truck/tray to segment the fillable area, for example, the size of the cover over the operator's cabin, and these strategies have an advantage since the current strategy relies on the tray being relatively 'empty'.

Finding the Truck and Tray: Method 2

The second method for truck/tray identification and localisation differs from the first method only in Step 3. This second method refines the estimate of the truck image pose through the use of a least-median-squares optimisation. The optimisation refines the pose estimate through an iterative search of the possible rotations and translations which would best describe the transform of the thresholded blob (truck/tray candidate) to the origin, using a template of how the blob 'should' look at the origin. The error function for the optimisation is the count of pixels from the transformed blob which were outside the template at the origin. A Nelder-Mead minimiser was used for the search. This strategy greatly improved the precision of localisation of the tray, but the optimisation took significantly longer to execute.

Autonomous Truck Loading

In order to effectively load a truck tray, a loading strategy is required that ensures a desired loading profile is maintained and that the truck is loaded as close to its capacity as possible. Therefore, a set of optimised loading strategies were developed which determine appropriate dumping locations for complete tray loading and adapts online to prior passes. Some key features of the loading strategies include the ability to:

1. Maximise truck volume loading.
2. Minimise spillage of material during dumping.
3. Maintain desired loading distribution within tray.
4. Tray geometry independent (within reason).
5. Estimate multi-pass loading profiles.

6. Evaluate a cost function which considers loading profile, spillage, bucket volumes.
7. Re-evaluate loading profile and volume at each pass.

Two optimised loading strategies were developed; a 2-dimensional and a 3-dimensional method. The 2D strategy has simplifying assumptions which considers the loading profile along the longitudinal centreline of the truck tray as well as the vertical dump height, whereas the 3D strategy is an advanced method which considers loading in all three dimensions. Both methods were designed to operate in real-time, with the 2D method being faster than the 3D method at the expense of lateral distribution accuracy. The following sections describe both loading strategies.

Optimised Loading—2D

In the 2D strategy, some simplifying assumptions are made to increase the speed of computation. The analysis removes one degree-of-freedom (lateral) such that the system averages the load distribution across the width of the tray. This method utilises the 2D tray identification system to obtain the current load distribution and location of the tray with respect to the shovel. The main procedure to determine the dump locations is shovel_load_tray_dump_locations. The role of this procedure is to:

1. Find valid points which span across the entire tray and determine mean tray radius.
2. Scale and sort the data into bins.
3. Process binned data.
4. Estimate empty volume.
5. Start the loading optimisation procedure.

The following sections outline these tasks.

Step 1: Find Valid Points which Span Across the Entire Tray and Determine Mean Tray Radius This procedure utilises the 2D loading profile. Here there are $n_s$ processed radial scan lines and at each scan j, the mean radius of the tray is $r_{meanj}$. By processing all scans, the swing angle at the beginning and end of the tray are identified and denoted $'_{min}$ and $'_{max}$ respectively. Additionally, the mean radius along the length of the tray can be approximated by:

$$r_{tray} = \left[ \sum_{j}^{n_s} r_{meanj} \right] \Big/ n_s$$

Step 2: Scale and Sort the Data into Bins

The start and end locations of the tray, $x_s$ and $x_f$ respectively, are approximated using the mean radius and swing angles such that:

$$x_S = r_{tray}\,'_{min}$$

$$x_f = r_{tray}\,'_{max}$$

where $'_{min}$ and $'_{max}$ are the start and end of the identified tray respectively.

The estimated tray length is therefore approximated as:

$$l_{tray} = x_f - x_s$$

To simplify the analysis, the mean height in discrete bins ($n_b$) along the length of the tray is determined such that (e.g. 50 bins). The index of each scan within the binned array is determined by:

$$ind = \text{floor}[(r_{tray}\,'_j - x_s)/x]$$

where $x = r_{tray}('_j - '_{j-1})$.

The stored mean height data for each scan from the tray identification is processed and sorted into the discrete bins, with the average of all scan contributions in each bin calculated. This data is stored in the vectors x[50] and z[50].

Step 3: Process Binned Data

Once all the tray identification scans have been stashed in the variables x[50] and z[50], the minimum and maximum heights are determined, $z_{min}$ and $z_{max}$ respectively.

Step 4: Estimate Empty Volume

Figure 10:
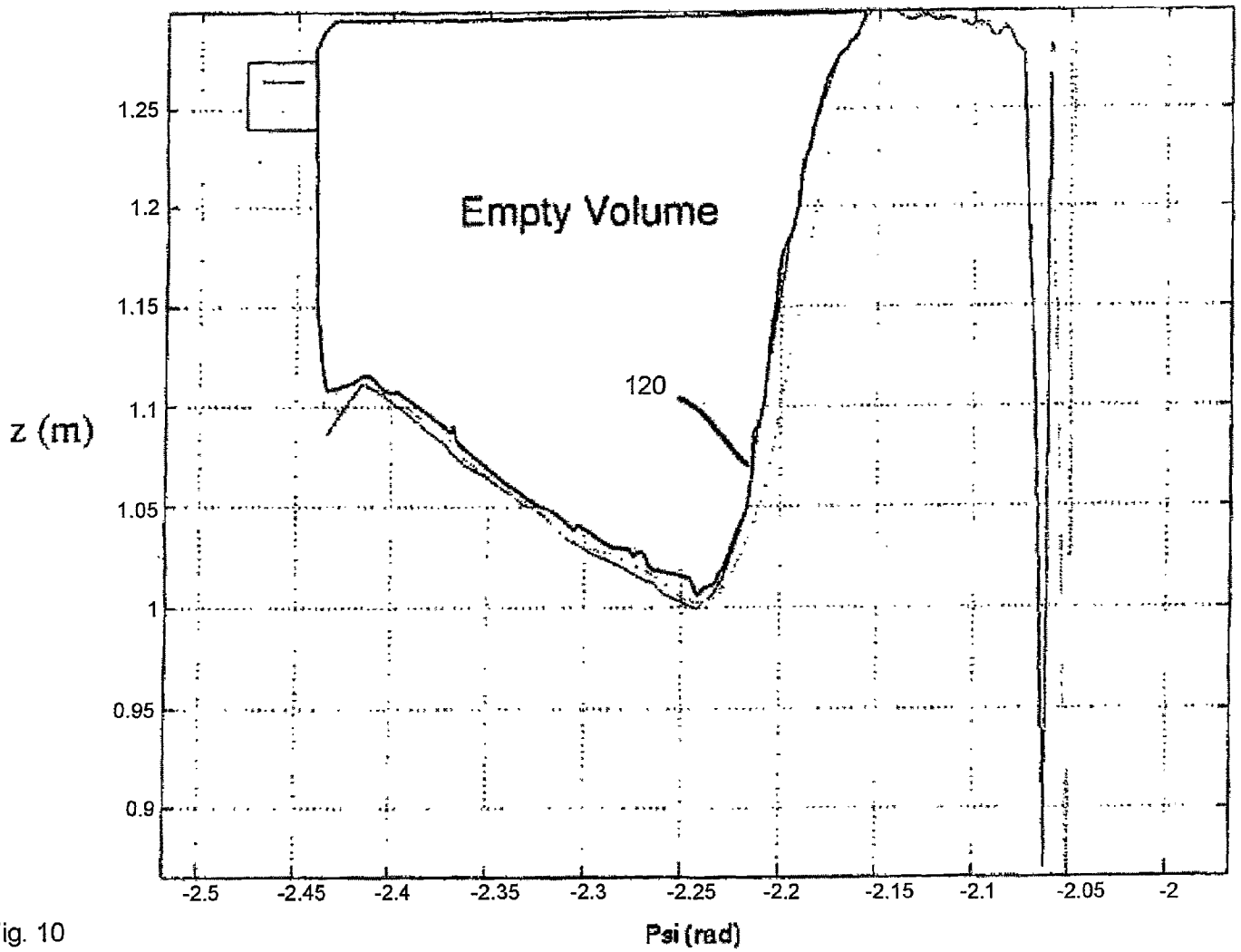
FIG. 10 is a plot of the volume of an empty tray.

It is generally of importance to estimate the volume of the tray and the volume remaining after each consecutive dumping. The empty volume ($V_e$) can be estimated as:

$$Ve = \left[ \sum_{i}^{n_b} (z_{max} - z_i) w_t \right] \Big/ x$$

where $z_i$ is the height at $x_i$ (bin i) and $w_t$ is the average of the tray width dr determined using the 2-dimensional method. This simplified volume estimation assumes that the loading is based on the inside volume of a line 120 at the maximum height of the tray as shown in FIG. 10.

Step 5: Start the Loading Optimisation Procedure

A procedure was developed to predict the load distribution from the number of passes ($n_p$) ahead of current pass. This can be updated at any time during the loading process. To predict the load distribution the procedure assumes:

1. The bucket is filled to its maximum capacity with volume $V_b$.
2. The material flows in a triangular fashion with a repose angle of $\|_R$.
3. The load is distributed at the same height across the width of the tray.
4. The material flows from a fixed point $x_S$.

Figure 11:
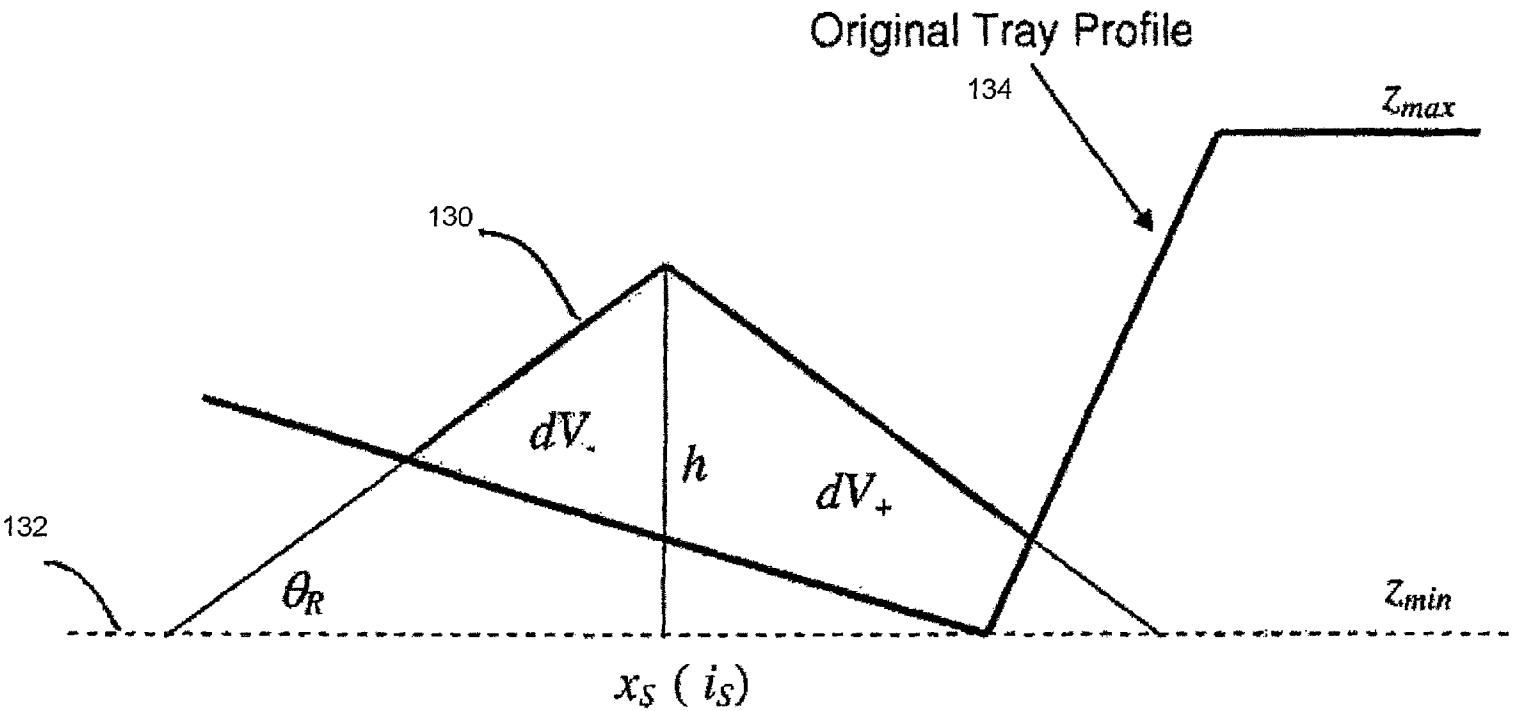
FIG. 11 is a theoretical plot of a loading distribution concept.

The idea here is to 'grow' the triangle 130 from the bottom of the tray 132 until the volume enclosed by the loaded material and the original profile of the truck tray 134 equals the bucket volume. FIG. 11 illustrates the loading concepts.

The load optimisation procedure consists of two steps:

1. Determine the load distribution at point $x_S$.
2. Evaluate the cost function for the estimated loading condition.

In the case of multi-pass fills, the first step is repeated for two different loading points, then the cost function is evaluated. The function hovel_load_tray_estimate_fill_height calculates the anticipated material height in the tray after dumping a bucket of volume $V_b$ centred around point $x_s$ with array index $i_S$. Referring to FIG. 11 the height at $i_S$ is given as $$h = i_S x \tan\|R$$

and the total height $h_j$ from $i_S$ towards the front of the tray at index j is given by $$h_j = h - \tan\|_R (x_i - x_{iS})$$

$$z_{+j} = z_j - z_{min}$$

where $z_{+j}$ is the material height within the tray.

If ($h_j > z_{+j}$), then new total height of the material in the tray ($z_{newj}$) is stored and the volume of the segment ($dV_+$) is given by $$dV_+ = \simeq ((h_j - z_{+j}) w_t x)$$

$$z_{newj} = h_j + z_{min}$$

This is repeated for indices less than $i_S$, that is towards the rear of the tray. Therefore, if ($h_j > z_{+j}$) then $$dV_- = \cong ((h_j - z_{-j}) wtx$$

$$z_{newj} = h_j + z_{min}$$

This procedure is calculated for all points within the loading triangle with the volume of dirt determined as $V_{dirt}=dV_{+}+dV_{-}$ If $V_{dirt}=V_b$, then the procedure is stopped and the estimated load distribution ($z_{new}$) is returned. If it is determined that there is spillage of material either over the front or rear of the tray before the bucket volume is reached, a spilledDirt flag is set and that dump location $i_S$ is considered invalid.

In multi-pass filling, the above sequence is repeated by firstly placing a bucket at a position $i_S$, and then keeping this distribution constant, another bucket is placed at various locations and a new distribution calculated. This can be repeated as many times as considered feasible. Once a bucket of dirt is determined validly dumped into the tray, the load distribution is evaluated by a cost function which determines the squared weighted difference between an assumed 'ideal' loading profile and the estimated profile. For example, in a two pass fill, with the position of the first bucket load placed at index p and the second load placed at q, the cost function $J_{pq}$ is determined as $$J_{pq} = \sum_{i}^{n_b} W_J (z_{max} - z_{pqi})^2$$

where $W_J$ is a variable weighting factor. The variability is required to penalise spillage and dumping over the cab of the truck.

Therefore, the optimal solution is taken as the minimal $J_{qp}$ for multiple dumping positions over the entire length of the tray. The two dump locations, $x_p$ and $x_q$ that minimise $J_{pq}$ over the entire tray are taken as the dumping points to for the bucket, $x_1$ and $x_2$ respectively. The swing angles of the dump location are then determined as $$'_1='_{min}+x_1/r_{tray}-\Omega$$

$$'_2='_{min}+x_2/r_{tray}-\Omega$$

Loading Performance

Figure 12:
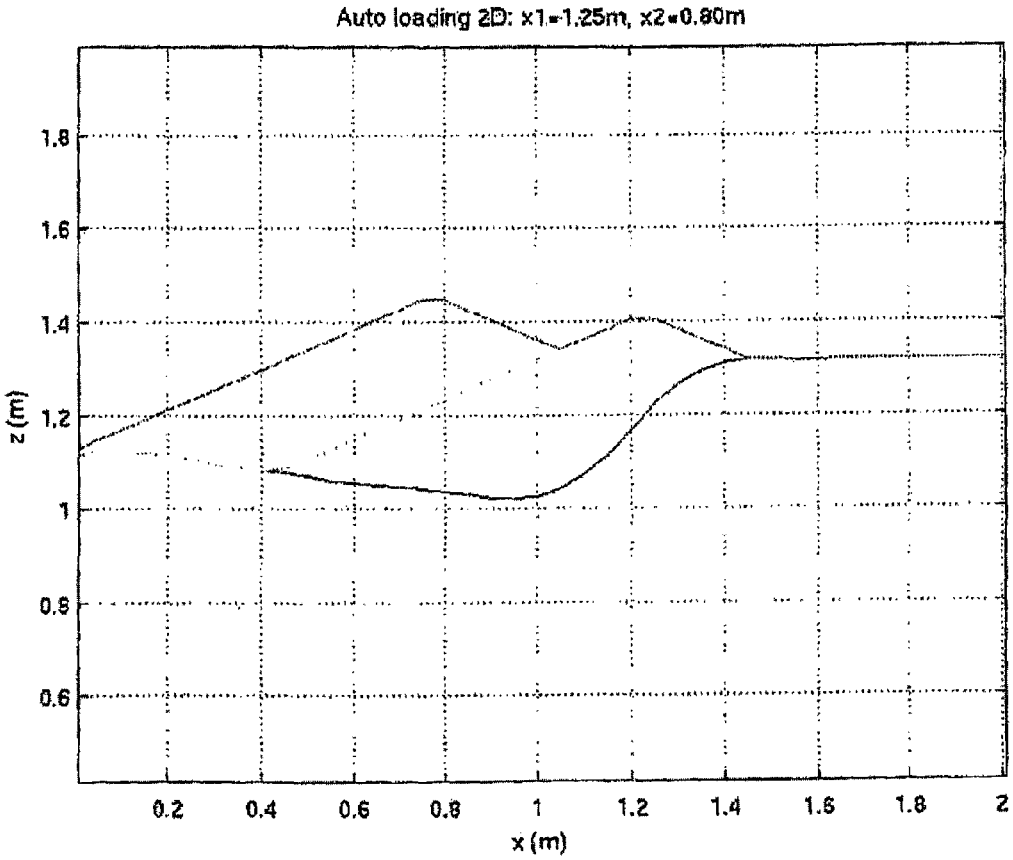
FIG. 12 is a plot of an optimised 2-dimensional load distribution after two passes.

The loading procedure determined from the 2D tray identification procedure was applied to an experimentally measured tray. FIG. 12 shows the estimated optimised loading distribution after two full buckets have been dumped into the tray. It can be seen that the material is dumped without spillage from the rear of the tray, and there is minimal over cabin loading.

Figure 13:
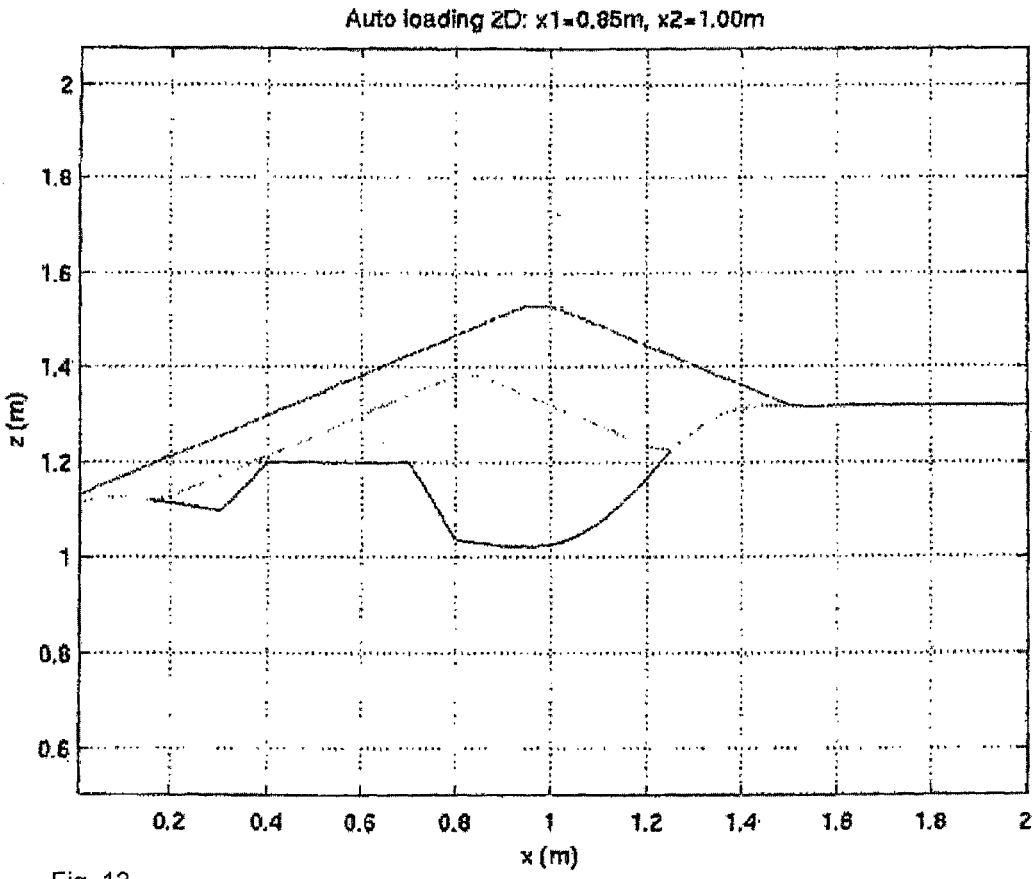
FIG. 13 is a plot of an optimised 2-dimensional load distribution after two passes—decreased initial tray volume.
Figure 14:
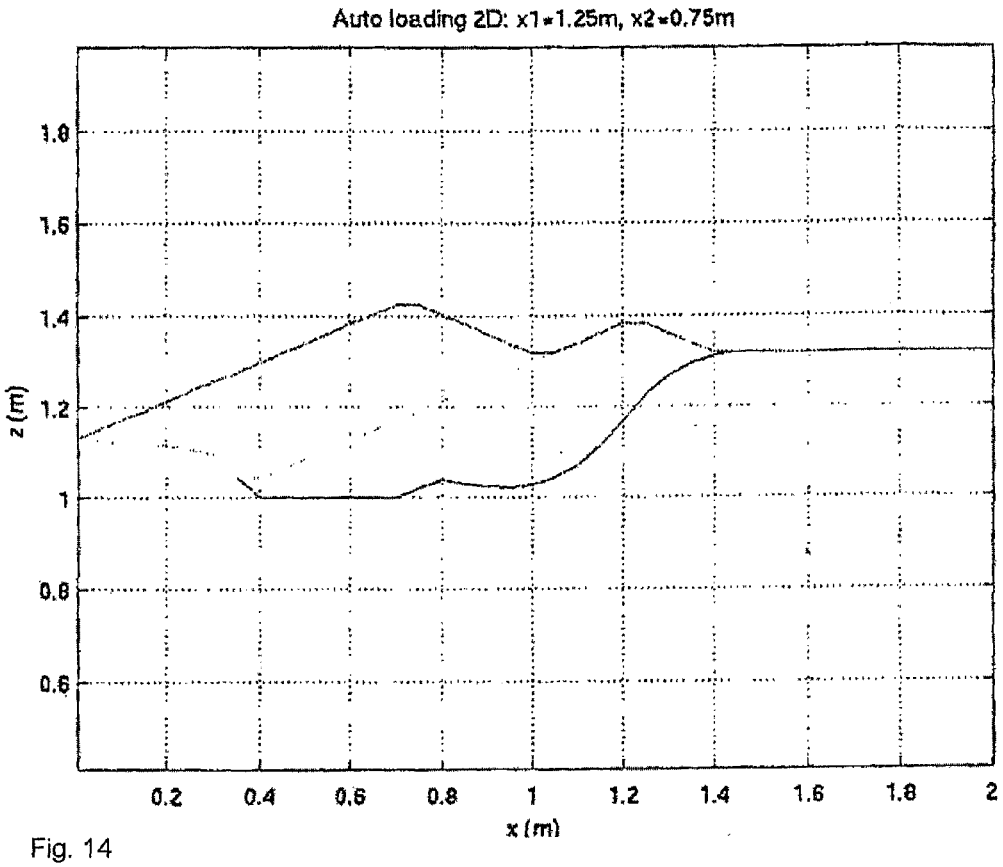
FIG. 14 is a plot of an optimised 2-dimensional load distribution after two passes—increased initial tray volume.

The case study was extended to observe the effect of artificially altering the initial tray scan on the resulting optimised loading positions and material distribution. FIG. 13 shows the results of increasing the initial volume of the tray, whereas, FIG. 14 shows the results of decreasing the initial volume of the tray. In both cases, the loading distribution can be seen to change slightly. The final loading distribution can be altered via the weighting of the cost function. In the examples shown, a high penalization was applied to any material that is dumped over the cabin head board.

Optimised Loading—3D

The three-dimensional loading strategy relies on height encoded occupancy grids. The loading strategy involves optimisation of the load position based on the current loading condition of the tray and an 'idealized' full tray. To do this, the truck/tray, as identified and localised using the 3-dimensional methods, in addition use is made of expected loading parameters such as material repose angle. The method can optimise for single or two-pass fills but could also be used, at additional computational cost, for higher pass fills.

An Ideally Loaded Tray

To develop an 'ideally' loaded tray, knowledge of the tray geometry is required together with the expected material repose angle. Given these parameters, the maximum volume of material which could be loaded into the tray is essentially 'grown' from the tray edges using the material repose angle, the coordinates of the edges of the fillable area, and the height of these edges. The fillable portion of the tray is then found (as described above). Then, because the algorithm described here relies on knowledge of the fillable area coordinates, an empty tray needs to be the scanned prior to creation of the 'ideally' filled tray. Of course, other means could be used to derive the coordinates of the fillable section of the tray to remove this requirement. A more realistic approach would be to perhaps identify the truck/tray type from the image and to use truck/tray manufacturer specifications to drive the shape of an 'ideally' loaded tray.

Load Positioning and Estimation

The algorithm for load positioning is described in the following sections. Essentially, it relies on the idea of 'growing' a load into the truck tray until the additional volume is equivalent to that contained in a normal bucket load. This estimated load is then compared to that of the ideal tray described earlier. The differences between the 'ideal' tray and the currently estimated load are then used to calculate some 'cost' at each load position, together with a further term which can influence the position of the load (here the load is driven towards the centre of the tray).

Step 1: Initialize the Search

A new load of material will only 'fit' into certain regions of the segmented area of the tray due to the shape that the material acquires upon settling. This constrains the search for loading positions. This simply involves a reduction in area from the segmented 'fillable' region (identified above); here the search region is reduced by a grid square in each coordinate direction.

Step 2: Create a Material Load Estimate

The next step is to create an estimate of a 'pile' of loaded material. This estimate is essentially a cone which is created given a material repose angle, a position, and a height. The algorithm returns the true cone volume and the quantized volume, along with an image of the 'cone' of material. This 'pile of material' can then be moved to different locations and 'pushed' into the tray to create a load estimate.

Step 3: Search for the Loading Position

The search of the load position can be either for a one-pass or a two-pass fill. This search involves the calculation of a 'cost' at each possible loading position. The cost function consists of terms for forcing the shape of the estimated load to that defined by the ideal tray, and also terms for centralizing its position with respect to the tray. At each load position, the 'cone' of material is pushed into the tray until such time as the difference between the current tray volume and the estimated tray volume with the new pile of material is equal to the volume contained in a normal bucket load. The cone of material is 'pushed' into the tray by incrementally increasing the cone's height offset and combining this image with the image of the tray—this is achieved through a max function applied at each pixel in the image.

In summary, for each of the coordinates in the drop zone:

1. 'Push' the cone into the tray until such time as the difference between the current tray volume and the estimated volume with the new pile of material is equal to the volume contained in a normal bucket load, checking for spilling etc. If it isn't possible to get a complete bucket of material into the tray at this position, then continue to the next coordinate pair.

2. If it is a multi-pass fill:
   (a) For each of the drop zone coordinates:
      (i.) Push the cone into the tray until such time as the difference between the current estimated tray volume and the estimated volume with the new pile of material is equal to the volume contained in a normal bucket load. If it isn't possible to get a complete bucket of material into the tray at this position, then continue to the next coordinate pair.
      ii. Calculate the 'cost' of the new tray, storing the position with the lowest cost. Cost is defined as being the volume difference between the currently estimated loaded tray and the ideal tray. The cost function also contains a term to drive the load position towards a centred position in the tray.
3. else
   (a) Calculate the 'cost' of the new load estimate, storing the position with the lowest cost.
4. Given an optimal loading position(s), use the same process to estimate the load at the selected position, again by pushing a cone into the tray. Store the image of this loading condition, and return the number of passes which were possible and the appropriate loading coordinates. If it isn't possible to obtain a load with a complete bucket, this case is flagged to the calling function. The algorithm can also be used when there is a load already in the tray.

Step 4: Transform the Optimal Loading Position to Shovel Coordinates

The optimal loading position is calculated from an image of the truck/tray which has been transformed to the Cartesian origin. This position has to be transformed back to coordinates which are meaningful to the shovel, and then into commands which the control system can respond to. In other words, the selected loading position needs to be transformed to a swing angle, a bucket height, and a bucket radius, and then passed to the shovel control system.

Although the invention has been described with reference to a particular example, it should be appreciated that it could be exemplified in many other forms and in combination with other features not mentioned above. For instance, it should be noted that the invention is not limited to the use of laser scanners, but that any other suitable scanning range finder could be used; including radar, ultrasonic and stereo camera systems.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

REFERENCES

[1] H. N. Cannon. Extended earthmoving with an autonomous excavator. Master's thesis, The Robotics Institute, Carnegie Mellon University, Pittsburgh, Pa. 15213, May 1999.

[2] P. Corke and M. Dunbabin. ACARP Project C12030 Rope shovel automation. Technical report, ACARP, 2004.

[3] P. Corke, P. Sikka, J. Roberts, and E. Duff. DDX: A distributed software architecture for robotic systems. In *Australasian Conference on Robotics & Automation*, Canberra, December 2004.

[4] M. Dunbabin, P. Corke, G. Winstanley, and J. Roberts. Off-world robotic excavation for large-scale habitat construction and resource extraction. In *To Boldly Go Where No Human-Robot Team Has Gone Before: Papers from the 2006 Spring Symposium*, ed. Terry Fong, pages 95-103. Technical Report SS-06-07. American Association for Artificial Intelligence, Menlo Park, Calif., 2006.

[5] J. Hansen. Electric rope shovel monitoring. *CIM Bulletin,* 94(1052):80-82, July 2001.

[6] P. Lever and R. McAree. ACARP Project C11054 open-cut automation scoping study. Technical report, CMTE, 2003.

[7] H. P. Moravec and A. Elfes. High resolution maps from wide angle sonar. In *IEEE International Conference on Robotics and Automation*, pages 116-121, St. Louis, Mo., USA, 1985. IEEE Computer Society Press.

[8] J. Roberts, G. Winstanley, and P. Corke. Three-dimensional imaging for a very large excavator. *International Journal of Robotics Research,* 22(7-8):467-477, 2003.

[9] G. Sheppard, A. Jessett, E. Widzyk-Capehart, and A. McDonald. C11047: Real-time shovel operator feedback system. Final report, CMTE, August 2003.2003.

[10] S. Singh. Learning to predict resistive forces during robotic excavation. In *International Conference on Robotics & Automation*, pages 2102-2107, Nagoya, May 1995.

[11] S. Singh. The state of the art in autonomous earthmoving. *ASCE Journal of Aerospace Engineering,* 10(4), October 1998.

[12] G. Winstanley, P. Corke, M. Dunbabin, and J. Roberts. Dragline Swing Assist:ACARP C9028—final report. Technical report, ACARP, 2003.

[13] Australian Patent Application No. 199895225 (Carnegie Mellon University).

The invention claimed is:

1. A control method for loading equipment that performs one or more operational cycles, each of which involves:

positioning a dumping point, of the loading equipment, at a predetermined location above a receptacle to be loaded; and, dumping a quantity of material having less than or equal to a known volume into the receptacle from the dumping point;

wherein, the control method comprises the steps of:

simulating an effect of dumping the volume, using a repose angle of the material, at various locations above the receptacle;

comparing a result of dumping at each location with a template representing an ideally filled receptacle; and, selecting a location of the dumping point according to the results of the comparison.

2. A control method according to claim 1, wherein the simulating step additionally takes account of particle size, distribution, voiding and spillage.

3. A control method according to claim 1, wherein the selecting step involves iteratively testing the comparison at each location to find a best loading position.

4. A control method according to claim 1, wherein the selecting step involves assigning a cost to the comparison at each location to find a best loading position.

5. A control method according to claim 1, further comprising imaging the receptacle and a load of material as it is filled.

6. A control method according to claim 5, wherein imaging equipment is mounted on rotary loading equipment such that it scans in a vertical plane, and rotational motion of the loading equipment is used to build up a three-dimensional point cloud of the surrounding terrain from which a Digital Terrain Map (DTM) is generated.

7. A control method according to claim 5, wherein as the loading equipment moves toward or away from the dumping point the receptacle, including any load, is segmented from the background.

8. A control method according to claim 5, wherein imaging of the receptacle takes account of shadowing effects, to compensate where there are hidden parts of the interior of the receptacle.

9. A control method according to claim 5, wherein the receptacle is loaded from more than one side, and imaging is conducted from more than one side.

10. A control method according to claim 1, further comprising the step of identifying the receptacle, its location, orientation and geometry in 2 or 3 Dimensions.

11. A control method according to claim 1, wherein the simulating step includes using knowledge of a fillable part of the empty or partially filled receptacle, including the shape of a surface of the receptacle and an upper surface of any load in it, a maximum volume of a dump, and the repose angle of the material.

12. A control method according to claim 1, comprising the further step of determining whether the receptacle is full or not.

13. A control system for loading equipment that performs one or more operational cycles, each of which involves:

positioning a dumping point, of the loading equipment, at a predetermined location above a receptacle to be loaded; and, dumping a quantity of material having less than or equal to a known volume into the receptacle from the dumping point;

wherein, the control system comprises a computer system to:

simulate an effect of dumping the volume, using a repose angle of the material, at various locations above the receptacle;

compare a result of dumping at each location with a template representing an ideally filled receptacle; and, select a location of the dumping point according to the results of the comparison.

14. A non-transitory computer readable medium with an executable program stored thereon that when executed causes a computer to perform the method of claim 1.

* * * * *